US010807787B2

(12) United States Patent
LaMance et al.

(10) Patent No.: US 10,807,787 B2
(45) Date of Patent: Oct. 20, 2020

(54) MULTIPACK BEVERAGE CONTAINER INSULATION SYSTEM

(71) Applicant: Kanga, LLC, Taylors, SC (US)

(72) Inventors: Logan T. LaMance, Pickens, SC (US); Daniel Delegatti, Greenville, SC (US); Joseph M. Wilson, Columbia, SC (US); Shea W. Doonan, Rochester, MA (US); Ryan D. Frazier, Taylors, SC (US); Austin Maxwell, Atlanta, GA (US); Edward Giard, Jr., Severna Park, MD (US); Edward Giard, III, Severna Park, MD (US)

(73) Assignee: Kanga, LLC, Taylors, SC (US)

( * ) Notice: Subject to any disclaimer, the term of this patent is extended or adjusted under 35 U.S.C. 154(b) by 46 days.

(21) Appl. No.: 15/903,678

(22) Filed: Feb. 23, 2018

(65) Prior Publication Data

US 2018/0265276 A1 Sep. 20, 2018

Related U.S. Application Data

(60) Provisional application No. 62/471,790, filed on Mar. 15, 2017.

(51) Int. Cl.
*B65D 81/38* (2006.01)
*B65D 25/28* (2006.01)

(52) U.S. Cl.
CPC ..... *B65D 81/3834* (2013.01); *B65D 25/2858* (2013.01); *B65D 25/2873* (2013.01); *B65D 81/3893* (2013.01)

(58) Field of Classification Search
CPC ..... B65D 25/14; B65D 25/18; B65D 25/28; B65D 25/2873; B65D 81/18; B65D 81/38; B65D 81/3806; B65D 81/3834
USPC ..... 220/495.01, 495.03, 495.05, 592.2, 220/592.21, 592.23, 592.24, 592.26
See application file for complete search history.

(56) References Cited

U.S. PATENT DOCUMENTS

| | | | |
|---|---|---|---|
| 3,285,455 | A | 11/1966 | Pewitt |
| 3,848,766 | A | 11/1974 | Gantt et al. |
| 4,293,015 | A | 10/1981 | McGough |
| 4,858,444 | A | 8/1989 | Scott |
| 5,007,250 | A | 4/1991 | Musielak |

(Continued)

*Primary Examiner* — James N Smalley
*Assistant Examiner* — Madison L Poos
(74) *Attorney, Agent, or Firm* — Kim and Lahey Law Firm LLC; Douglas W. Kim

(57) ABSTRACT

An insulation system for beverage containers comprising: an inner container surrounding a plurality of cylindrical beverage containers contained in an inner container; a handle included in an inner container top panel; an outer container having a cavity defined in the outer container for receiving the inner container; a pair of lateral spacers disposed lengthwise along corresponding inner upper corners of the out container; an airspace defined between an inner container side panel and an external container side panel having a polygon cross-section; and, a handle access opening centrally defined in an outer container top panel allowing access to the handle of the inner container so that the beverage containers, inner container and out container can be transported using the handle wherein the width of the handle access opening is about one third the length of the outer panel top opening.

15 Claims, 7 Drawing Sheets

(56) References Cited

U.S. PATENT DOCUMENTS

| | | | | |
|---|---|---|---|---|
| 5,474,162 | A * | 12/1995 | Shyr | A45C 5/14 190/109 |
| 6,059,140 | A | 5/2000 | Hicks | |
| 6,109,059 | A | 8/2000 | Lebrun | |
| 6,722,520 | B2 * | 4/2004 | Hupp | B65D 33/2591 190/903 |
| 7,344,028 | B2 | 3/2008 | Hanson | |
| 8,005,717 | B2 | 8/2011 | Joo | |
| 8,777,045 | B2 * | 7/2014 | Mitchell | A45C 11/20 220/592.2 |
| 9,139,352 | B2 | 9/2015 | Seiders et al. | |
| 2008/0047967 | A1 | 2/2008 | Brunner et al. | |
| 2013/0200083 | A1 * | 8/2013 | Cunningham | B65D 81/389 220/592.2 |
| 2014/0209621 | A1 | 7/2014 | Irish | |
| 2014/0262861 | A1 * | 9/2014 | Crowe | B65D 81/18 206/216 |
| 2016/0101918 | A1 * | 4/2016 | Bates | B65D 71/36 206/428 |

* cited by examiner

MULTIPACK BEVERAGE CONTAINER INSULATION SYSTEM

1) FIELD OF THE INVENTION

This invention relates to a multipack beverage container insulation system for reducing heat loss, improving thermal resistance, and reducing condensation on conventional beverage containers.

2) DESCRIPTION OF THE RELATED ART

There is a widely felt need to keep chilled beverages cold once these beverages are removed from refrigeration units. For example, when enjoying outdoor activities such as camping, picnics, sporting events, beach, backyards, and the like, having beverages which remain cool a sufficient time to prevent the fluid from warming above a temperature that makes the beverage undesirable is a problem which much attention has been directed. Such beverages are commonly contained in cans, which generally include cylindrical side walls and circular ends secured to the side walls. These cans, typically made from think metal, are not necessarily the best solution for keeping the fluid in the container cold. As reported in Physics Today, humidity is an important factor contributing to the increased temperature of a can due to the latent heat that's released when water condenses on the outside of an aluminum can. In the report, temperature and condensation was plotted of a can filled with water as the relative humidity increased. This study concluded, "At 35° C. and a relative humidity greater than 60%, the temperature rise due to latent heating exceeds that due to heat transfer from dry air: Latent heating is the dominant factor warming your cold beer. The rate of latent heating decreases as the outside of the can warms, and the heating ceases completely once the can's surface temperature exceeds the dew point (the temperature to which air with a given water-vapor content must be cooled to become saturated) and water no longer condenses on it." *Physics Today* 66, 4, 74 (2013); doi: 10.1063/PT.3.1958. Therefore, it is advantageous not only to prevent heat transfer from radiation through the can but also to keep condensation from forming on the outside of the can.

Attempts to insulate and prevent condensation include U.S. Pat. No. 3,285,455 that is directed to an insulated cup or coaster, molded from expandable polystyrene or other insulation material, and combined with a plastic rim, having a flexible or movable flange molded as an integral part thereof, so that a beer or soft drink can may be inserted into the insulated cup or coaster, of somewhat larger diameter, and held snugly therein by the aforesaid movable flange. U.S. Pat. No. 6,059,410 is directed to an insulative jacket for a beverage container fabricated from a unitary blank of flexible insulative material into a main body forming an annulus with continuous upper and lower edges openable into an annular form for receiving the beverage container and collapsible along diametrically opposed fold lines into a flattened rectangular form when not in use, and a circular end wall connected to the lower edge of the annulus at diametrically opposed locations with a sewn fold line bisecting the wall to urge it to fold inwardly within the annulus when collapsed into the flattened rectangular form. Further, there is U.S. Pat. No. 3,848,766 that is directed to a Styrofoam block having six independent thermal chambers which seat six upwardly open cups. There has also been multiple studies seeking to improve the ability to a hand-carriable, insulated container pack for holding the temperature of food or drink containers for several hours without the use of either a hot or cold agent.

Further, U.S. Pat. No. 4,858,444 allows for multiple cans to be placed on a carrying case that has some insulating properties but does also require that the containers be removed from the packaging. The same disadvantage is present in U.S. Pat. Nos. 5,007,250; 6,109,059, and 9,139,352.

However, these attempted solutions require the beverage containers to be individualized and potentially separated from their original packaging.

There have been attempts to provide for carriers that insulate and allow for the containers to remain in the original packaging such as U.S. Pat. No. 7,344,028, but such attempts do not allow for the features of the original packaging to be utilized and reduce the functionality of the original packaging. However, this attempt makes no mention of reduced concentration properties nor of a layered air gap structure that increases insulation performance and reduces condensation. The prior art relies upon insulations such as the stretchable insulating material of United States Patent Application Publication 2014/0209621; goose down of U.S. Pat. No. 4,293,015, foam insulation layer of United States Patent Application Publication 2008/0047967, and a foam and insulation layer of U.S. Pat. No. 8,005,717. None of these attempts provide for an air gap to improve thermal insulation and reduce condensation.

Accordingly, it is an object of the present invention to provide for a carrier that can increase thermal insulation and reduce condensation of beverage containers without removing the beverage container from the original packaging.

It is another object of the present invention to provide for a carrier that can receive the original packaging without obscuring or reducing functionality of the features of the original container.

SUMMARY OF THE INVENTION

The above objectives are accomplished according to the present invention by providing an insulation system for beverage containers comprising: an inner container surrounding a plurality of cylindrical beverage containers stacked in a prone configuration widthwise in the inner container; a top opening defined in the top of the inner container defining a handle in the top of the inner container; a water resistant layer included in the inner container disposed on the external side of the inner container; an outer container having a cavity defined in the outer container for receiving the inner container; a pair of lateral spacers disposed lengthwise along corresponding inner upper corners of the outer container; an airspace defined between an inner container side panel and an external container side panel having a polygon cross-section with at least two unequal angles; a handle access opening defined in an outer container top panel allowing access to the handle of the inner container so that the beverage containers, inner container, and outer container can be transported using the handle; a handle access flap hingeably attached to the outer panel at one end, releasably attached to the outer container at the other end, and having an area less than one third the area of the outer container top panel; an access side panel hingeably and sealably attached to the outer container for enclosing the inner container in the outer container; a vertical strap carried by the outer container for transporting the beverage containers, inner container, and outer container; and, a horizontal strap carried by the outer container horizontally surrounding the outer container to stabilize the vertical strap.

The invention can include the access side panel being hingeably connected to a bottom panel of the outer container. A sealing member can be included for releasably sealing the access side panel to the outer container selected from the group consisting of the hook and loop fastener, zipper, snaps, or any combination thereof. The top opening can be configured to allow a cylindrical beverage container to be retrieved from the inner container through the top opening. The outer container side panels, the outer container end panels, and the outer container bottom panel can be contiguous. The access side panel can be configured to be partially released to allow a cylindrical beverage container to be retrieved from the inner container through a partial side opening defined by the access side panel. The top opening can be defined in the outer container top panel and one of the outer container's side panels.

The vertical strap and the horizontal strap can be removably attached to the outer container. The horizontal strap is slidably attached to the vertical strap. The outer container can be resilient allowing its volume to increase to receive the inner container. The inner container includes a water resistance layer and has about a 1 mm thickness. The outer container can include an outer fabric layer for receiving printing. The top opening can extend to the width of top panel and partially into one of the outer container side panels. The outer container can include a thickness in the range of 0.5 mm and 4 mm. A side pouch 88 can be attached externally to the outer container and can removably receive individual beverage insulators 90 in the side pouch.

BRIEF DESCRIPTION OF THE SEVERAL VIEWS OF THE DRAWINGS

The construction designed to carry out the invention will hereinafter be described, together with other features thereof. The invention will be more readily understood from a reading of the specification and by reference to the accompanying drawings forming a part thereof, wherein an example of the invention is shown and wherein.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits, and advantages of the present invention will be apparent from this summary and certain embodiments described below, and will be readily apparent to those skilled in the art. Such objects, features, benefits, and advantages will be apparent from the above, in conjunction with the accompanying examples, data, figures, and all reasonable inferences to be drawn therefrom, alone or with consideration of the references incorporated herein.

DETAILED DESCRIPTION OF THE INVENTION

Figure 1:
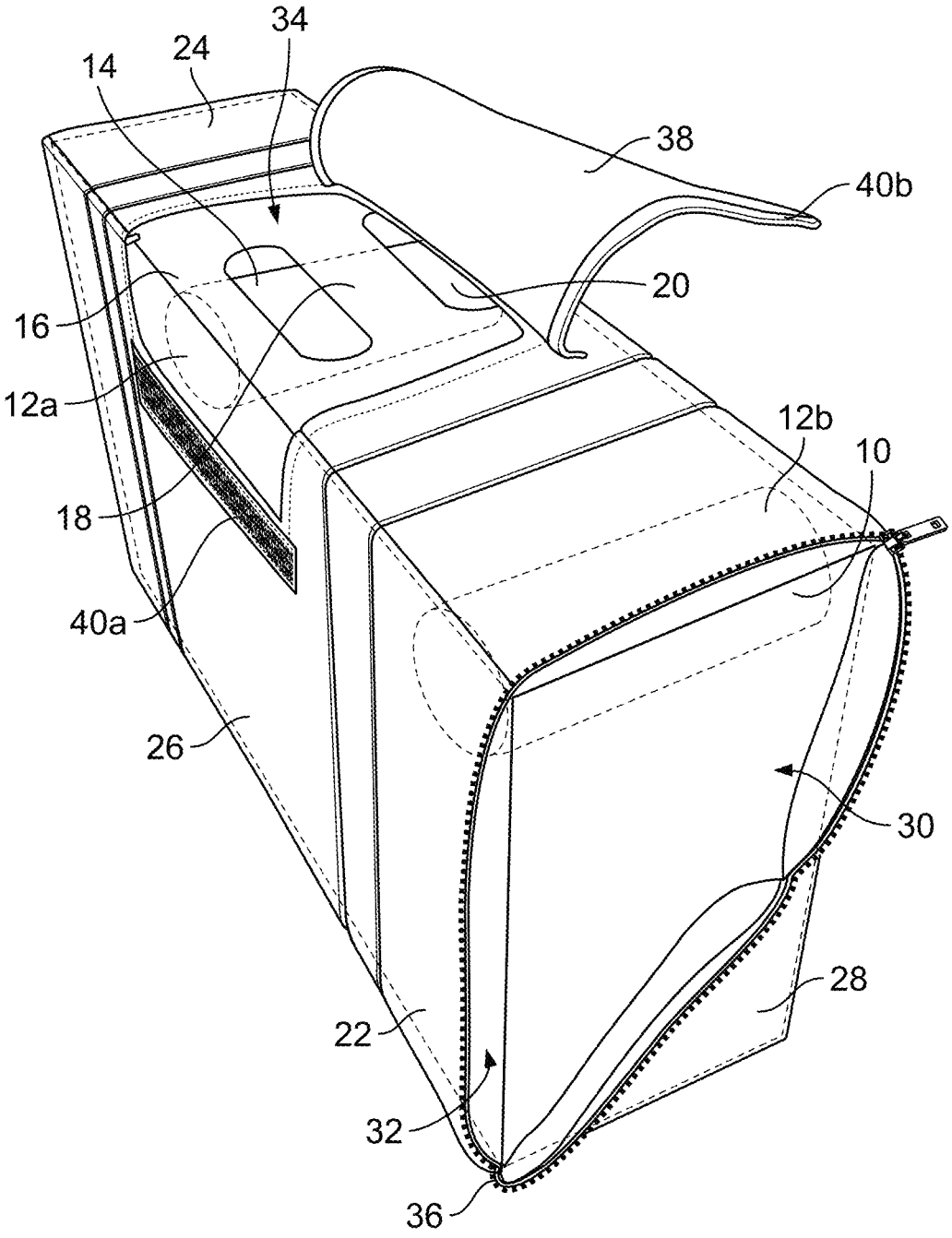
FIG. 1 is a perspective view of aspects of the invention.

With reference to the drawings, the invention will now be described in more detail. Referring to FIG. 1, an inner container 10 is shown having a plurality of cylindrical beverage containers such as 12*a* and 12*b* stacked in a prone configuration widthwise in the inner container. An top opening 14 can be defined in an inner container top panel 16 defining a handle 18. In one embodiment, there can be a second top opening 20 defined in the inner container top panel allowing the handle 18 to be accessed from both sides of the handle. A water resistant layer can be included in the inner container disposed on the external side of the inner container. The water resistant layers can be provided by a coating such an acrylic lattice coating, film, polymer coating, and the like. The inner container water resistant layer can be about 1 mm thick.

An outer container 22 can include an outer container top panel 24 outer container side panel 26 and removably attachable outer container end panel 28. The outer container end panel can be attached to the outer container using a zipper which can be included laterally along the outer container side panels and the outer container top panel. The outer container side panel can be hingeably attached to the outer container bottom panel at hinge 36. The outer container end panel can be partially released from the outer container allowing access to the inner container end panel or to an opening in the inner container top panel or inner container side panel to access or retrieve cylindrical beverage containers from the inner container. The outer container side panel can also be attached to the container using a zipper, hook and loop fasteners, snaps, elastic bands, or any combination thereof. The outer container can have a thickness in the range of 0.5 mm to 4.0 mm.

A cavity 30 can be defined in the outer container for receiving the inner container. An airspace 32 can be defined between the inner container and the outer container having a polygon cross-section. In one embodiment, the polygon is a triangle. In one embodiment, the polygon has at least two unequal angles.

An access opening 34 can be defined in the outer container top opening allowing access to the handle 18. By allowing access to the inner container through the access opening, the cylindrical beverage containers, inner container, and outer container can be transported using the handle. The access opening 34 can also allow for the cylindrical containers to be removed from the inner container through an opening defined in the inner container such as by tearing or removing a section of the inner container. The access opening can be have an area less than one third the area of the outer container top panel in one embodiment. The access opening can be defined in the outer container top and extend to into one of the outer container side panels.

An access flap 38 can be hingeably attached to the outer container at one end and releasably attached to the outer container as the other end. The flap can be releasably attached to the outer container using a hook and loop fastener having releasable members 40*a* and 40*b*. In one embodiment, the access flap can be completely removed from the outer container.

Figure 2:
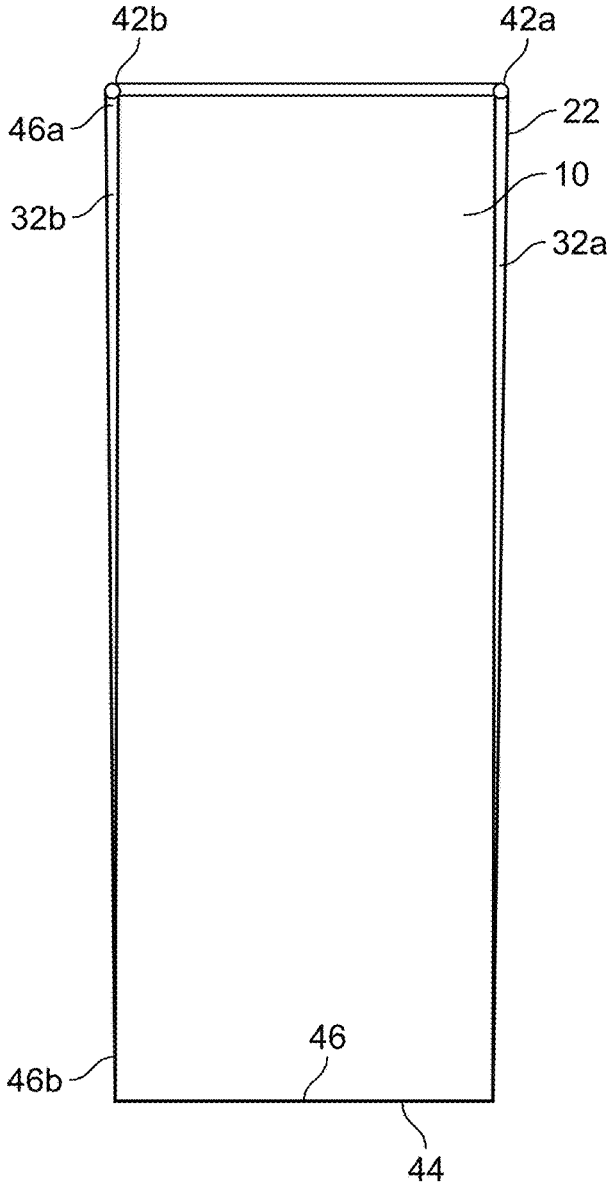
FIG. 2 is a cross section of aspects of the invention.

Referring to FIG. 2, the cross section of the inner container 10 received in the outer container 22 is shown. The outer container can include a pair of lateral spacers 42*a* and 42*b* that can be attached to an interior surface of the outer container along the seams or edge of the outer container to panel to define lateral airspaces 32*a* and 32*b* between the inner container and the outer container. The outer container bottom panel 44 can be adjacent to the bottom panel 46 of the inner container defining the lateral airspaces to have a polygon cross section. In one embodiment, the polygon is a triangle. In one embodiment, a first angle 46*a* and a second angle 46*b* are unequal.

Figure 3:
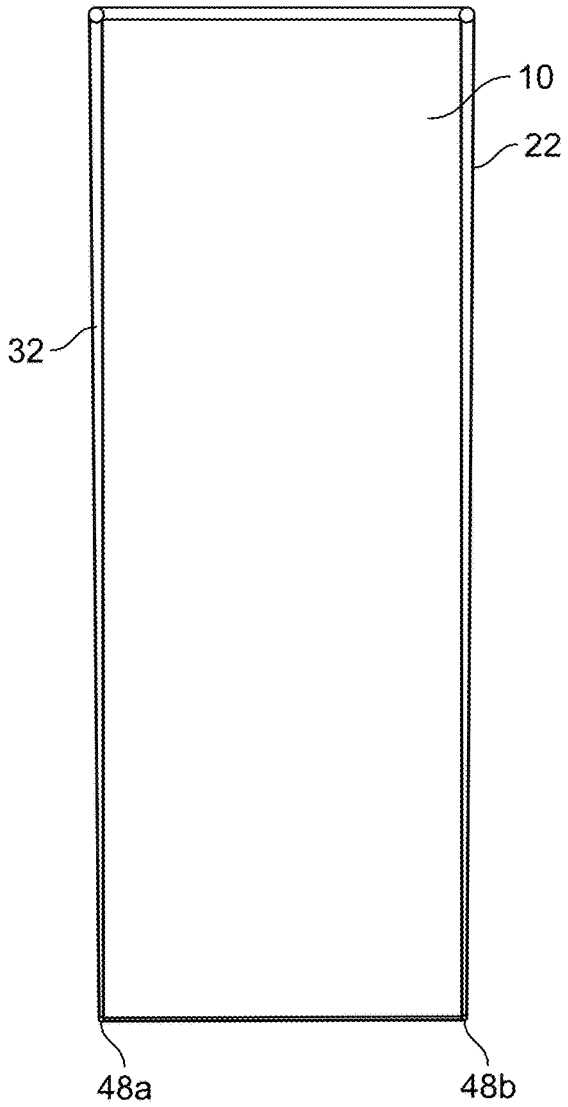
FIG. 3 is a cross section of aspects of the invention.

Referring to FIG. 3, the polygon defined between the outer container and the inner container includes airspace 32 that includes an airspace having polygon cross section with four sides. Bottom spaces 48*a* and 48*b* define the airspace in this embodiment. In one embodiment, the spaces are seams separating the outer container from the inner container.

Figure 4:
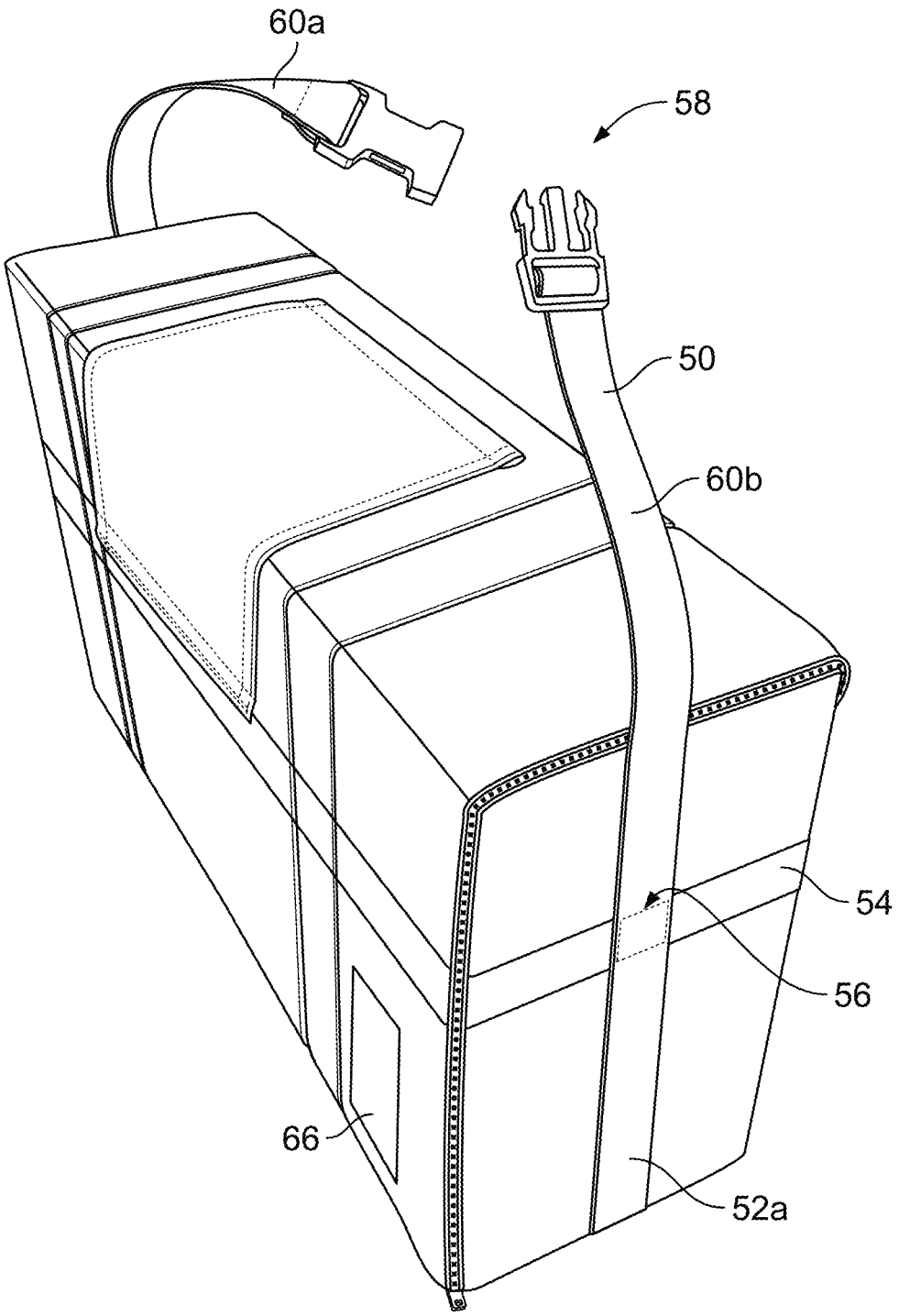
FIG. 4 is a perspective view of aspects of the invention.

Referring to FIG. 4, a vertical strap 50 can include a lower portion 52*a* that can be attached to the outer container. In one embodiment, the lower portion extends from one outer container end panel across the outer container bottom panel and to the opposite outer container end panel so that the strap supports the inner container and the outer container relieving pressure on the outer container bottom panel by the inner container when the outer container is lifted by the vertical strap. A horizontal strap 54 can be attached to the vertical strap and extend around the outer container horizontally to keep the vertical strap in place. In one embodiment, the vertical strap is slidably attached to the horizontal strap. The vertical strap can include a slot 56 for receiving the horizontal strap. The slot can be vertically or horizontally defined in the strap. A buckle 58 can be included in the vertical strap allowing the vertical strap top portion 60*a* and 60*b* to be releasably joined. The vertical and horizontal straps can be removably attached to the outer container.

In one embodiment, the outer container can include an outer pouch 66 that is configured to receive individual beverage insulators that can be manufactured from the same material as the outer container. One or more individual beverage insulators can be received in the pouch.

Figure 5:
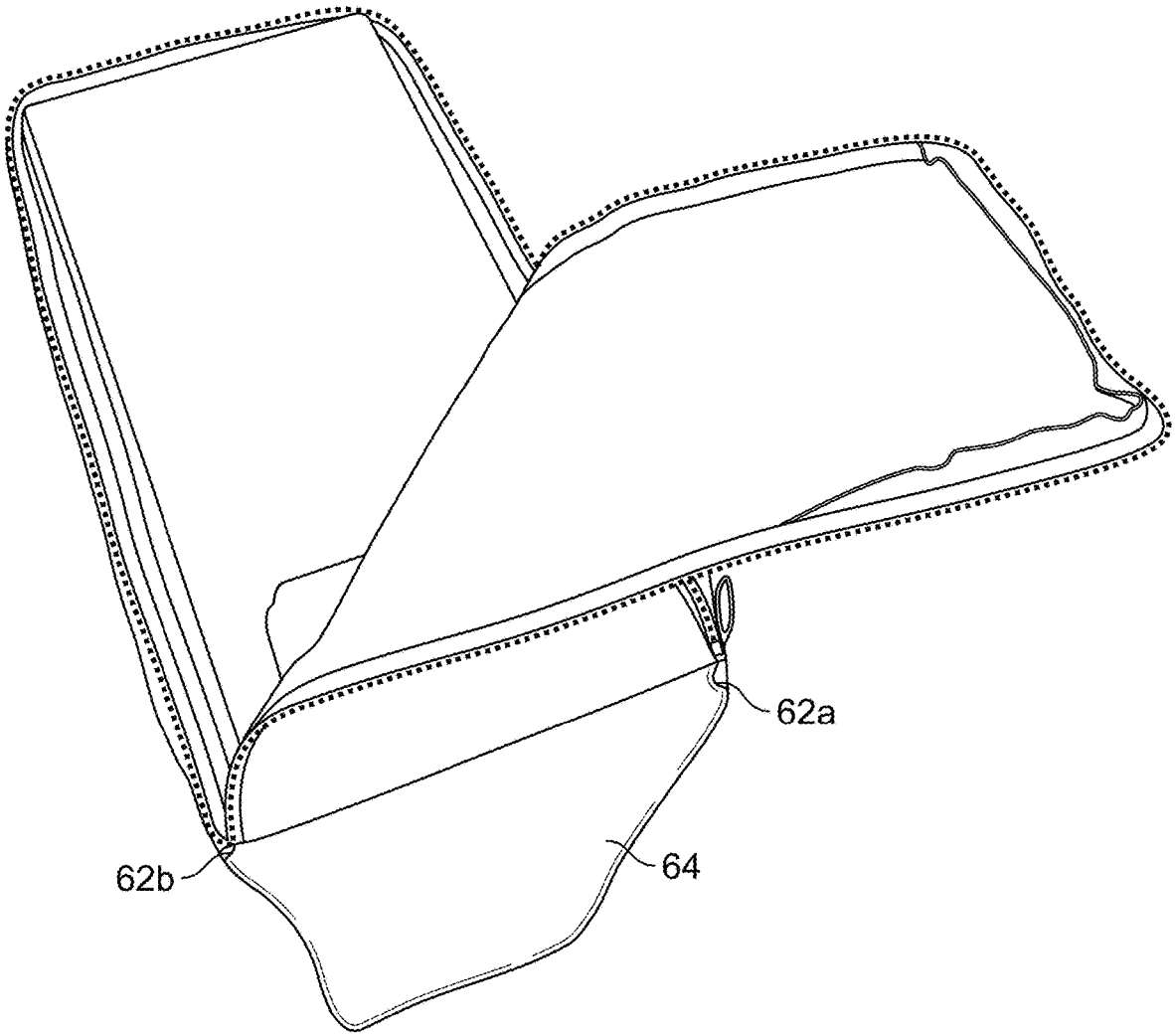
FIG. 5 is a perspective view of aspects of the invention.

Referring to FIG. 5, the outer container bottom 64 panel can be contiguous with the outer container side panels and be folded at folds 62*a* and 62*b*. The outer container end panels can be contiguous with the outer container bottom panel. The outer container can be resilient and have a first volume without the inner container is received in the outer container wherein the first volume is less than a second volume wherein the inner container is received in the outer container.

The invention can include an R value associated with insulating the individual beverage container that is the sum of the R values of the beverage container, inner container, airspace, and outer container. The insulation wall of the present invention can include the inner container, airspace, and outer container so that condensation is reduced and insulation is increased. The inner surface of the outer container can include a reflective layer of material such as a material marketed as Mylar®. The outer container can include an outer layer of insulation material such as neoprene or scuba foam. The outer container can include an inner layer that is reflective and/or water resistance.

Figure 6:
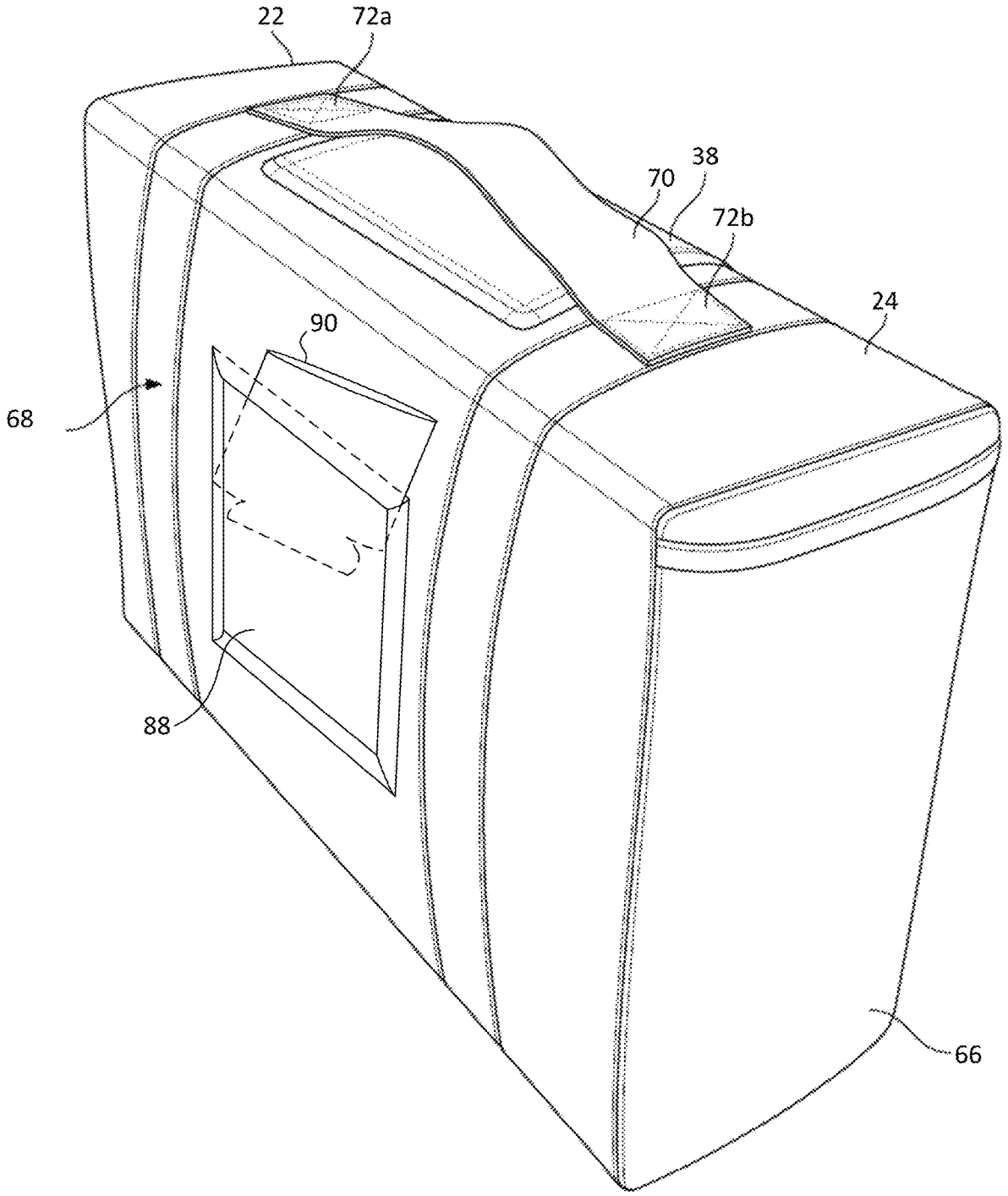
FIG. 6 is a perspective view of aspects of the invention.

Referring to FIG. 6, the outer container can include a back side 66 that can be imprinted with a design 68. An carry handle 70 can be carried by the outer container. The carry handle can be attached to the outer layer top panel 24 at points on either side of the access opening or the access flap 38. The carry handle can be attached at handle lateral attachment points 72*a* and 72*b*. A pocket 74 can be included in one of the panels, such as the side panel, for carrying articles such as individual beverage container insulators.

Figure 7A:
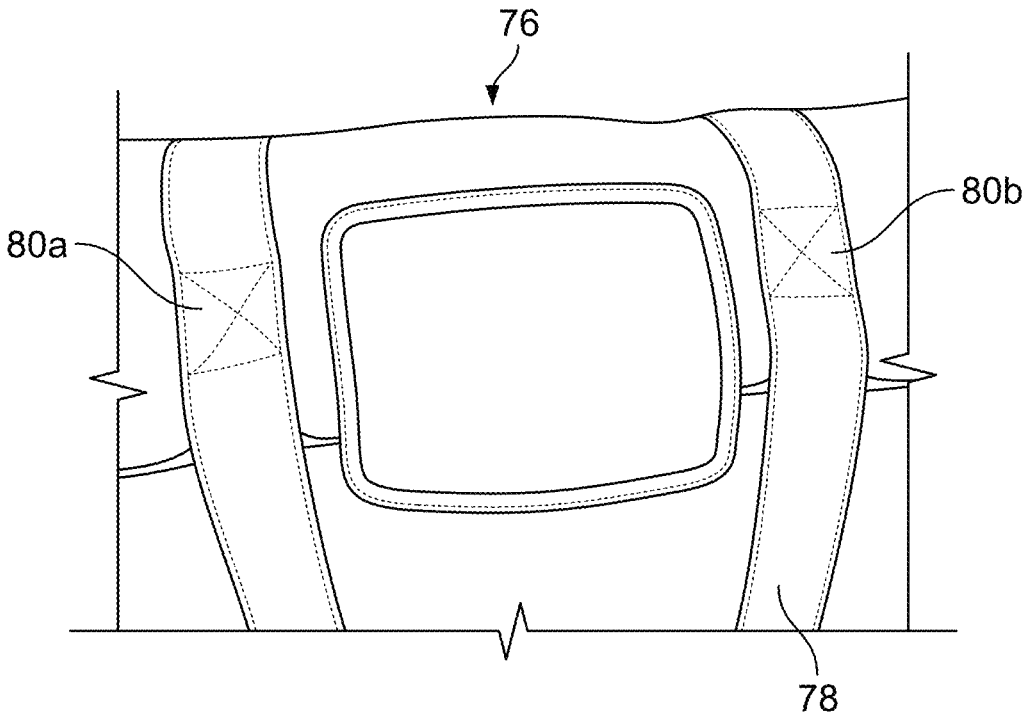
FIGS. 7A and 7B are internal views of aspects of the invention.
Figure 7B:
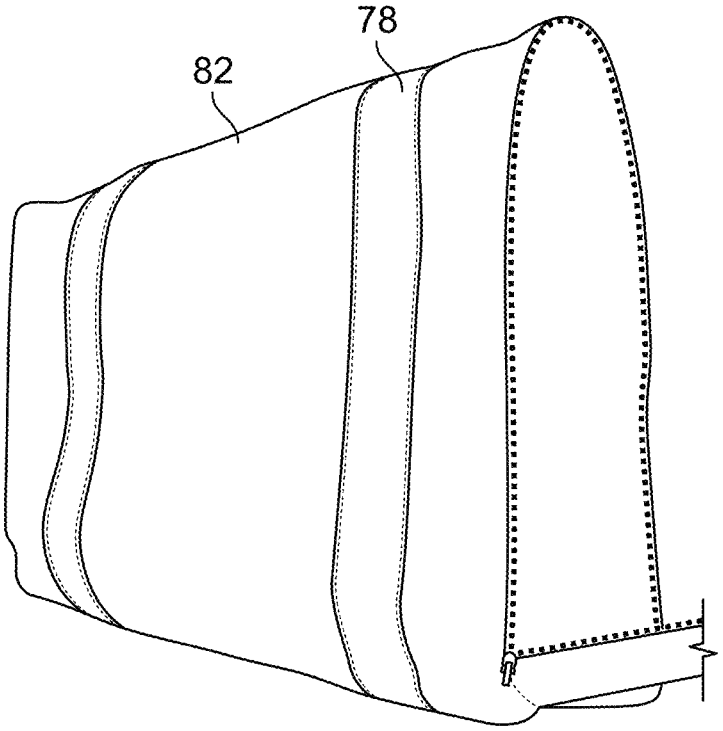

Referring to FIGS. 7A and 7B, the interior 76 of the outer container is shown. One or more support straps 78 can be attached to the inner surface of the outer container. The support straps can circumvent the inner container when the inner container is received in the outer container. The carry handle can be attached to the support straps at interior points 80*a* and 80*b* so than when lifting force is applied to the carry handle, the support straps can lift the interior container. The support straps can be disposed on either side of the access opening defined in the outer container. The inner layer 82 of the outer container can include a reflective surface and/or water resistance surface.

Figure 8:
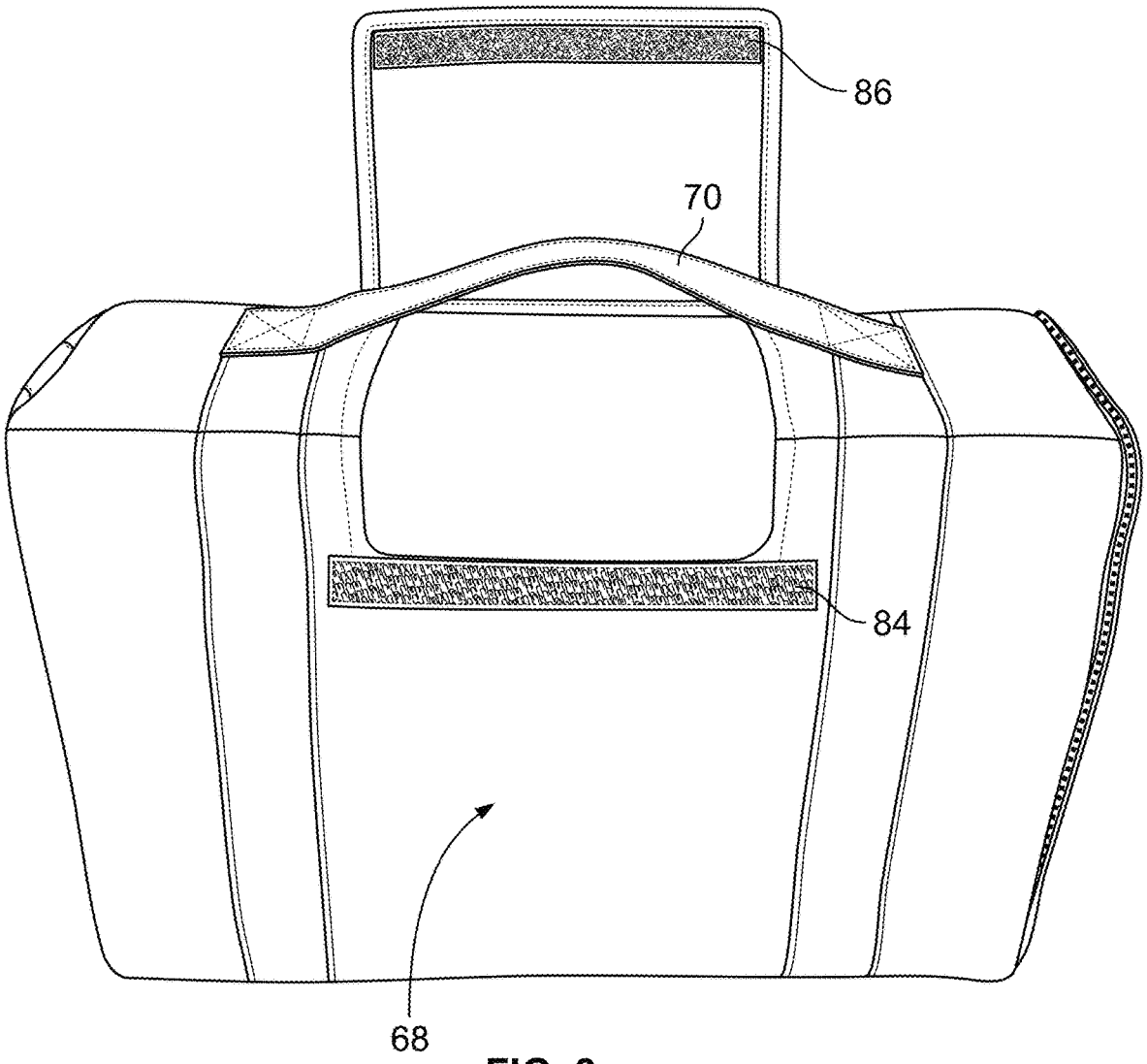
FIG. 8 is a front view of aspects of the invention.

Referring to FIG. 8, the outer container is shown with carry handle 70. A hook and loop fastener strip 84 can be attached to the outer container and engage with the corresponding hook and loop fastener 86 of the access flap 38. When closed, the access flap can be disposed over the carry handle or under the carry handle. The side can be imprinted with a design 68.

It is understood that the above descriptions and illustrations are intended to be illustrative and not restrictive. Other embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventor did not consider such subject matter to be part of the disclosed inventive subject matter.

What is claimed is:

1. An insulation system for beverage containers comprising:

an inner container surrounding a plurality of cylindrical beverage containers stacked in a prone configuration widthwise in the inner container;

a top opening defined in an inner container top panel defining a handle in the top of the inner container;

a first water resistant layer included in the inner container disposed on an external side of the inner container;

a second water resistant layer included in an interior of an outer container disposed on the external side of the inner container;

a reflective layer included in an interior of the outer container disposed on the external side of the inner container; an outer container having a cavity defined in the outer container for receiving the inner container;

a pair of lateral spacers disposed lengthwise along corresponding inner upper corners of the outer container;

an airspace defined between an inner container side panel and an external container side panel having a polygon cross-section with at least two unequal angles;

an access opening defined in an outer container top panel allowing access to the handle of the inner container so that the beverage containers, inner container, and outer container can be transported using the handle;

an access flap hingeably attached to the outer panel at one end, releasably attached to the outer container at the other end, and having an area less than one third the area of the outer container top panel; an access side panel hingeably and sealably attached to the outer container for enclosing the inner container in the outer container;

a vertical strap carried by the outer container for transporting the beverage containers, inner container and outer container; and, a horizontal strap carried by the outer container horizontally surrounding the outer container to stabilize the vertical strap wherein the horizontal strap is slidably attached to the vertical strap.

2. The insulating system of claim 1 wherein the access side panel is hingeably connected to a bottom panel of the outer container.

3. The insulating system of claim 1 including a sealing member for releasably sealing the access side panel to the outer container selected from the group consisting of the hook and loop fastener, zipper, snaps, elastic bands, or any combination thereof.

4. The insulation system of claim 1 wherein the top opening is configured to allow a cylindrical beverage container to be retrieved from the inner container through the top opening.

5. The insulating system of claim 1 wherein the outer container side panels, the outer container end panels, and the outer container bottom panel are contiguous.

6. The insulating system of claim 1 wherein the access side panel is configured to be partially released to allow a cylindrical beverage container to be retrieved from the inner container through a partial side opening defined by the access side panel.

7. The insulating system of claim 1 wherein the top opening is defined in the outer container top panel and one of the outer container's side panels.

8. The insulating system of claim 1 wherein the vertical strap and the horizontal strap are removably attached to the outer container.

9. The insulating system of claim 1 wherein the outer container is resilient allowing its volume to increase to receive the inner container.

10. The insulating system of claim 1 wherein the inner container includes a water resistance layer and is about 1 mm thickness.

11. The insulating system of claim 1 wherein the outer container includes an outer fabric later.

12. The insulating system of claim 1 wherein the top opening extends to the width of top panel and partially into one of the outer container side panels.

13. The insulating system of claim 1 wherein the outer container has a thickness in the range of 0.5 mm and 4 mm.

14. The insulating system of claim 1 including a side pouch attached externally to the outer container.

15. The insulating system of claim 14 including single beverage insulators removably received in the side pouch.

* * * * *